US008992234B2

(12) United States Patent
Yoshioka et al.

(10) Patent No.: US 8,992,234 B2
(45) Date of Patent: Mar. 31, 2015

(54) HOLDING METAL FITTING, CONNECTOR ELEMENT, AND CONNECTOR

(75) Inventors: Kohsuke Yoshioka, Mie (JP); Yoji Miyazaki, Mie (JP); Tsuyoshi Kuninaka, Cupertino, CA (US)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 13/983,551

(22) PCT Filed: Feb. 2, 2012

(86) PCT No.: PCT/JP2012/052360

§ 371 (c)(1),
(2), (4) Date: Aug. 2, 2013

(87) PCT Pub. No.: WO2012/108328

PCT Pub. Date: Aug. 16, 2012

(65) Prior Publication Data

US 2013/0316598 A1 Nov. 28, 2013

(30) Foreign Application Priority Data

Feb. 7, 2011 (JP) ..... 2011-024199
Sep. 9, 2011 (JP) ..... 2011-196665

(51) Int. Cl.
*H01R 12/00* (2006.01)
*H01R 12/71* (2011.01)
*H01R 12/70* (2011.01)

(52) U.S. Cl.
CPC ..... *H01R 12/716* (2013.01); *H01R 12/7029* (2013.01)
USPC ..... 439/74

(58) Field of Classification Search
USPC ..... 439/660, 65, 66, 680, 357, 74, 862, 439/733.1
See application file for complete search history.

(56) References Cited

U.S. PATENT DOCUMENTS

| | | | | |
|---|---|---|---|---|
| 5,188,535 | A * | 2/1993 | Bertho et al. | 439/83 |
| 5,626,482 | A * | 5/1997 | Chan et al. | 439/74 |
| 7,658,636 | B2 | 2/2010 | Takeuchi et al. | |
| 8,408,931 | B2 * | 4/2013 | Sato et al. | 439/357 |
| 2008/0207014 | A1 | 8/2008 | Takeuchi et al. | |
| 2008/0268711 | A1 | 10/2008 | Miyazaki et al. | |

FOREIGN PATENT DOCUMENTS

| | | | |
|---|---|---|---|
| JP | 6-60066 | U | 8/1994 |
| JP | 2006-048970 | A | 2/2006 |
| JP | 2006-210182 | A | 8/2006 |
| JP | 2008-270099 | A | 11/2008 |

OTHER PUBLICATIONS

International Search Report issued in International Application No. PCT/JP2012/052360 with Date of mailing May 1, 2012.

* cited by examiner

*Primary Examiner* — Edwin A. Leon
(74) *Attorney, Agent, or Firm* — McDermott Will & Emery LLP

(57) ABSTRACT

A holding metal fitting 40 includes: a substantially L-shaped body portion that has a side plate portion 41 and a bottom plate portion 42; an anchor portion 45 that bent from the side plate portion 41 in a direction (longitudinal direction) Y intersecting a height direction (vertical direction Z) of the housing 21 and bites into the housing 21; and a hook portion 48 that is bent from the anchor portion 45 in a direction (vertical direction) Z intersecting an extended direction (longitudinal direction) Y of the anchor portion 45.

11 Claims, 13 Drawing Sheets

(a)

(b)

HOLDING METAL FITTING, CONNECTOR ELEMENT, AND CONNECTOR

RELATED APPLICATIONS

This application is the U.S. National Phase under 35 U.S.C. §371 of International Application No. PCT/JP2012/052360, filed on Feb. 2, 2012, which in turn claims the benefit of Japanese Application No. 2011-024199, filed on Feb. 7, 2011 and Japanese Application No. 2011-196665, filed Sep. 9, 2011, the disclosures of which Applications are incorporated by reference herein.

TECHNICAL FIELD

The present invention relates to a holding metal fitting, to a connector element using the holding metal fitting, and to a connector.

BACKGROUND ART

Heretofore, a connector has been known, in which a holding metal fitting is embedded in a peripheral wall portion of a housing of a socket (one of connector elements) (for example, refer to Patent Literature 1).

The holding metal fitting of Patent Literature 1 includes a substantially L-shaped body portion having a side plate portion and a bottom plate portion, and anchor portions which bite into a housing are provided on the side plate portion of the body portion, whereby it is made possible to enhance rigidity and strength of the housing.

CITATION LIST

Patent Literature

[PTL 1] Japanese Patent Laid-Open Publication No. 2008-270099

SUMMARY OF INVENTION

Technical Problem

However, in the above-described conventional holding metal fitting, the anchor portions which bite into the housing are only bent from the side plate portion in a direction intersecting a height direction of the housing, and accordingly, there has been an apprehension that the holding metal fitting may come off from the housing by external force and the like.

In this connection, it is an object of the present invention to obtain: a holding metal fitting capable of making itself difficult to come off from the housing of the connector element; a connector element using the holding metal fitting; and a connector.

Solution to Problem

In order to achieve the foregoing object, the present invention relates to a holding metal fitting embedded in a housing of a connector element, including: a substantially L-shaped body portion that has a side plate portion and a bottom plate portion; an anchor portion that is bent from the side plate portion in a direction intersecting a height direction of the housing and bites into the housing; and a hook portion that is bent from the anchor portion in a direction intersecting an extended direction of the anchor portion.

Advantageous Effects of Invention

According to the present invention, there are provided: the anchor portion that bites into the housing; and the hook portion that is bent from the anchor portion in the direction intersecting the extended direction of the anchor portion, so that the holding metal fitting can be further suppressed from coming off from the housing.

That is to say, according to the present invention, there can be obtained: the holding metal fitting capable of making itself difficult to come off from the housing of the connector element even if the external force and the like are inputted thereto; the connector element using the holding metal fitting; and the connector.

BRIEF DESCRIPTION OF DRAWINGS

FIG. 4(*a*) is a perspective view; and FIG. 4(*b*) is a side view.

FIG. 6(*a*) is a perspective view; and FIG. 6(*b*) is a side view.

DESCRIPTION OF EMBODIMENTS

Figure 1:
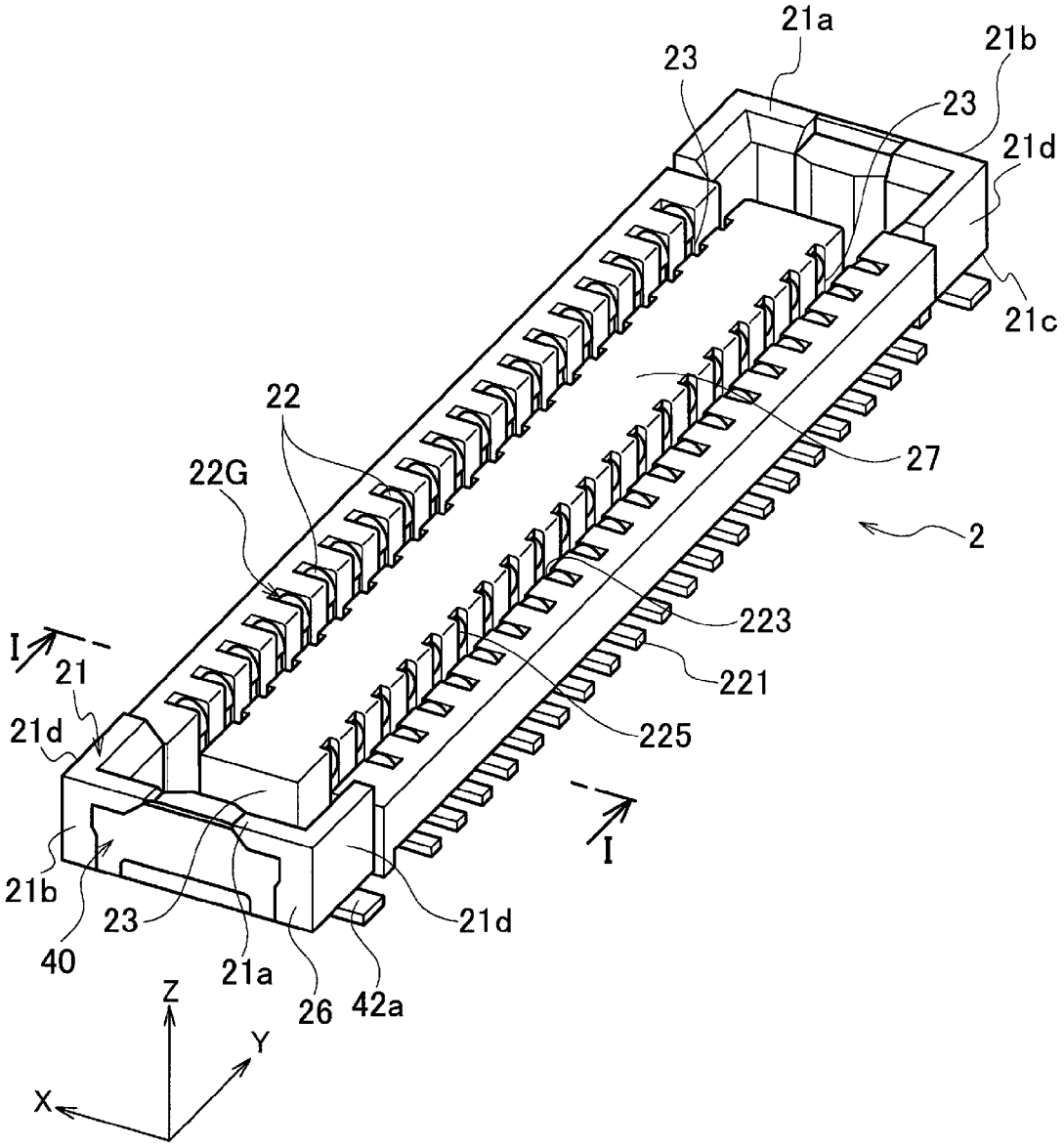
FIG. 1 is a perspective view of an entire socket of a connector according to a first embodiment of the present invention when viewed from obliquely above.

A description is made below in detail of embodiments of the present invention while referring to the drawings.

First Embodiment

Figure 2:
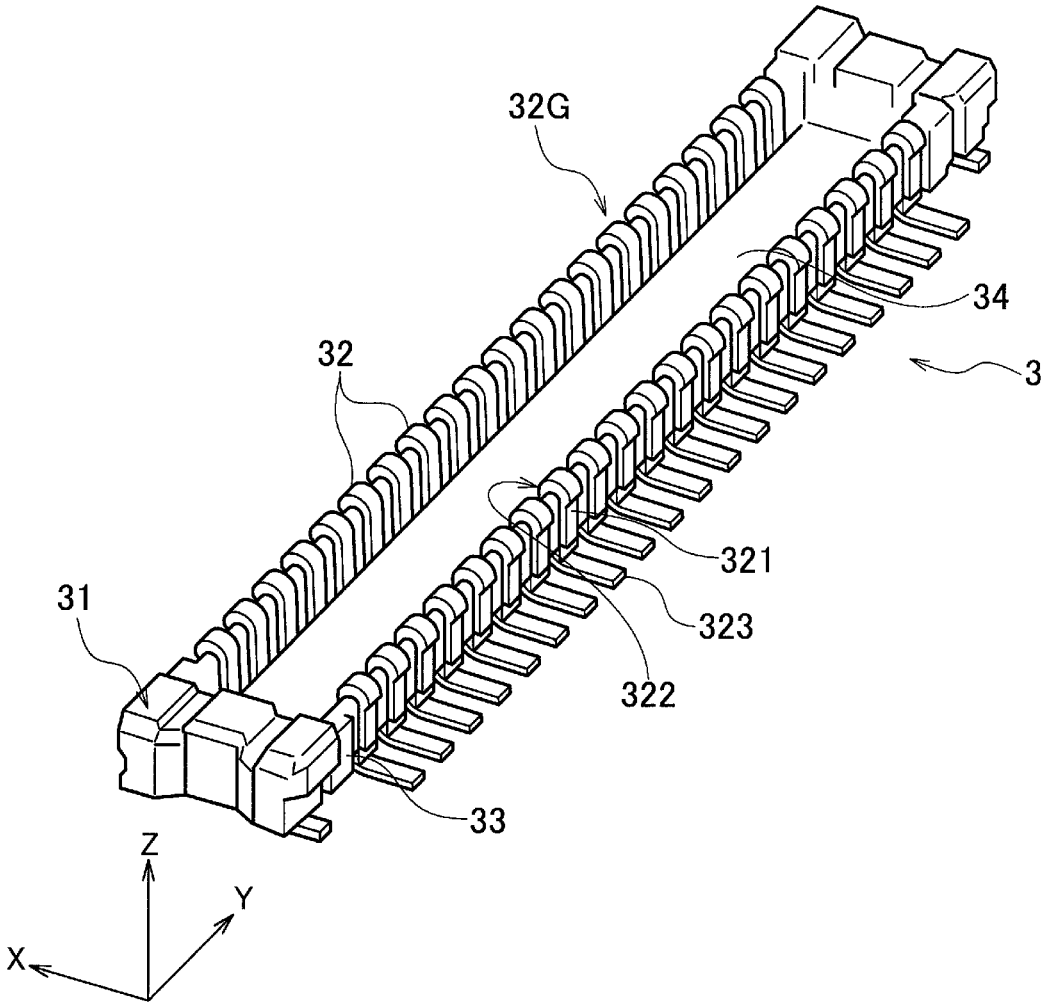
FIG. 2 is a perspective view of an entire header of the connector according to the first embodiment of the present invention when viewed from obliquely above.

FIG. 1 to FIG. 5 show a first embodiment of a connector 1 according to the present invention, and as shown in FIG. 1 and FIG. 2, the connector 1 according to this embodiment includes a socket 2 and a header 3, which are fitted to each other. Note that, in describing this embodiment, the description is made on the assumption that, as shown in these drawings, an X-direction in the drawings is defined as a width direction, a Y-direction therein is defined as a longitudinal direction, and a Z-direction therein is defined as a vertical direction (height direction).

As shown in FIG. 1, the socket 2 includes: an elongated rectangular socket housing 21 formed of an insulating material such as synthetic resin; and a plurality of contacts 22 mounted along long sides of the socket housing 21, which are opposite to each other, at a predetermined pitch.

The socket housing 21 includes: a peripheral wall portion 26 formed continuously into a substantially rectangular ring shape along a peripheral edge portion thereof; and a substantially rectangular island portion 27 formed on a center portion thereof to be spaced apart from the peripheral wall portion 26 at a predetermined interval. Then, a recessed portion 23 for fitting the header 3 into the socket 2 concerned is formed between these peripheral wall portion 26 and island portion 27.

In this embodiment, a pair of the contacts 22 is provided on both sides in the width direction X of the socket 2 provided with the recessed portion 23, and a plurality of the pairs of contacts 22 are individually arrayed in the longitudinal direction Y of the socket 2, to thereby constitute a socket-side terminal group 22G.

Figure 3:
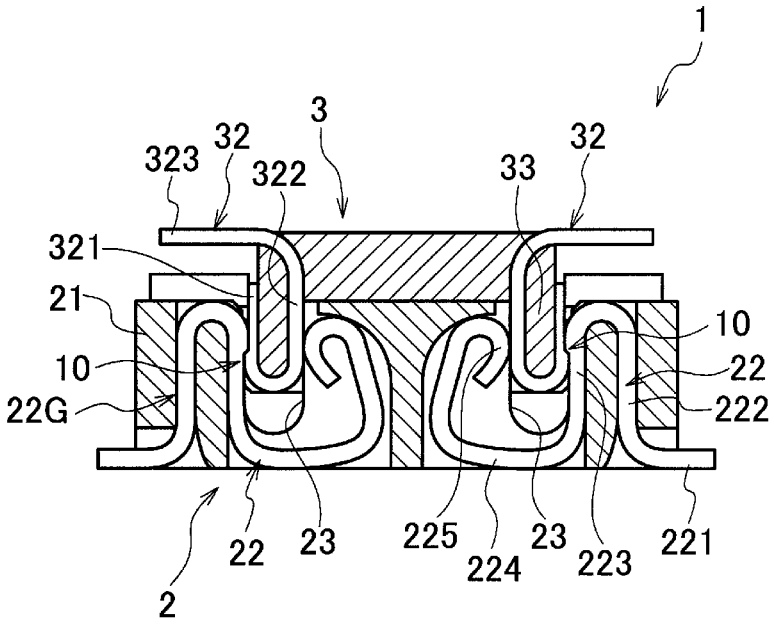
FIG. 3 is a cross-sectional view of a coupling state of the connector according to the first embodiment of the present invention, cut along a portion corresponding to a line I-I in FIG. 1.

Each of the contacts 22 is formed by bending an elastic material such as elongated metal having conductivity. As shown in FIG. 3, the contact 22 includes: a terminal portion 221 that protrudes outward in the width direction X of the socket housing 21; and a held portion 222 extended upward from an inner end portion of the terminal portion 221 and held on the socket housing 21. Moreover, the contact 22 includes: a first contact portion 223 extended downward while being curved from an upper end portion of the held portion 222 inward of the socket housing 21; and a coupling portion 224 further extended inward of the socket housing 21 from a lower end portion of the first contact portion 223. Furthermore, the contact 22 includes a second contact portion 225, which is erected upward from an inner end portion of the coupling portion 224, and allows a tip end portion thereof to protrude while being curved in a direction of being opposite to the first contact portion 223. As described above, the contact 22 of this embodiment includes the terminal portion 221, the held portion 222, the first contact portion 223, the coupling portion 224, and the second contact portion 225.

Then, the first contact portion 223 and the second contact portion 225 are provided with repulsive force in directions to oppose each other, and these first contact portion 223 and second contact portion 225 are arranged so as to be exposed in the recessed portion 23 of the socket housing 21 mentioned above. Moreover, the terminal portion 221 is arranged so as to protrude outward along a lower end of the socket housing 21. The terminal portion 221 that protrudes from the socket housing 21 as described above is mounted on one of wiring boards (not shown).

Meanwhile, the header 3 includes: an elongated rectangular header housing 31 made of an insulating material such as synthetic resin in a similar way; and a plurality of posts 32 mounted along the long sides of this header housing 31, which are opposite to each other, at a pitch equal to the pitch of the contacts 22.

The header housing 31 includes a peripheral wall portion 33 formed continuously into a substantially rectangular ring shape along a peripheral edge portion thereof, in which a substantially flat bottom wall portion 34 is formed inward of this peripheral wall portion 33.

Then, a pair of the posts 22 are provided on both ends in the width direction X of the header 3 provided with the peripheral wall portion 33, and a plurality of the pairs of posts 32 are individually arrayed in the longitudinal direction Y of the header 3, whereby a header-side terminal group 32G is composed.

Each of the posts 32 is formed by bending an elastic material such as elongated metal having conductivity in a similar way to the contacts 22. As shown in FIG. 3, the post 32 includes: a first contact portion 321 exposed to an outer side surface of the housing 321; and a second contact portion 322 bent downward in a U-shape from an upper end portion of the first contact portion 321. Moreover, the post 32 includes a terminal portion 323 that protrudes from the second contact portion 322 outward in the width direction X of the header housing 31.

Then, the first contact portion 321 and the second contact portion 322, which are bent in the U-shape, sandwich the peripheral wall portion 33 of the header housing 31 from above, and in this state, the terminal portion 323 is arranged so as to protrude outward along a lower end of the header housing 31. Thus, the terminal portion 323 that protrudes from the header housing 31 as described above is mounted on other wiring board (not shown).

As shown in FIG. 3, the connector 1 that includes the socket 2 and the header 3 as described above inserts the peripheral wall portion 33, to which the posts 32 are individually attached, into the recessed portion 23, to which the contacts 22 are individually attached. In such a way, each of the first contact portions 321 of the posts 32 is brought into pressure contact with the first contact portion 223 of the contact 22 so as to be able to freely contact therewith and separate therefrom, and in addition, each of the second contact portions 322 of the posts 322 is brought into pressure contact with the second contact portion 225 of the contact 22. In this state, the contact 22 and the post 32 are electrically connected to each other, and can allow electrical conduction between the one wiring board and the other wiring board.

At this time, as shown in FIG. 3, on each of the first contact portions 223 of the contacts 22 and each of the first contact portions 321 of the posts 32, lock portions 10 are provided, which engage with such other-side terminals and maintain a coupling state between the socket 2 and the header 3.

Hence, when fitting the header 3 into the socket 2, the first and second contact portions 321 and 322 of the post 32 are inserted into the first and second contact portions 223 and 225 of the contact 22 while pushing open the first and second contact portions 223 and 225 concerned against such elastic force thereof, and the lock portions 10 are locked. Then, step difference surfaces of the lock portions 10 are engaged with each other as illustrated, whereby the coupling state between the socket 2 and the header 3 is maintained.

Meanwhile, when separating the socket 2 and the header 3 from each other, both of them are removed from each other in a direction of detaching the same from each other, whereby, while the step difference surfaces of the lock portions 10 are sliding relatively to each other, the first and second contact portions 223 and 225 of the contact 22 are pushed open, and such engagement of the lock portions 10 is released. In such a way, the socket 2 and the header 3 can be separated from each other.

Here, as shown in FIG. 1, a holding metal fitting 40 is attached to each end portion in the longitudinal direction Y of the socket housing (housing) 21. Each of the holding metal fittings 40 has attachment piece portion 42*a* which protrudes outward, and the attachment piece portions 42*a* are soldered to the one circuit board. In such a way, in combination with the fact that the terminal portions 221 of the contacts 22 are soldered to the one circuit board, the socket 2 is configured to be coupled strongly to the one circuit board.

Figure 4:
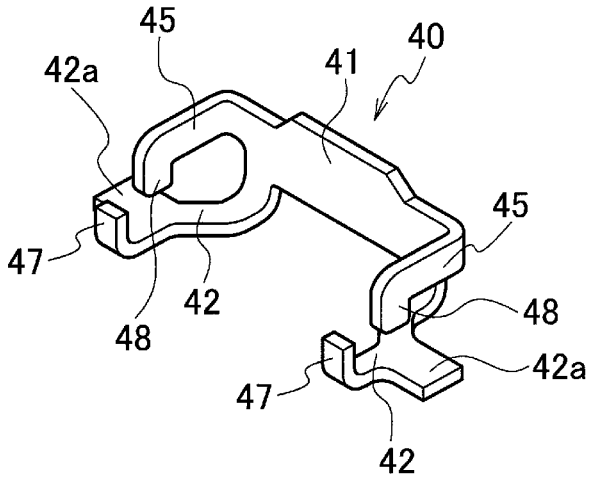
FIG. 4(*a*) and FIG. 4(*b*) are views showing a holding metal fitting embedded in a socket housing shown in FIG. 1.
Figure 4:
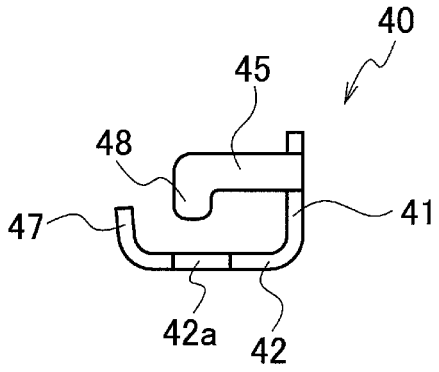

As shown in FIGS. 4(*a*) and 4(*b*), the holding metal fitting 40 is one formed by performing press molding for a metal plate with a predetermined thickness. Then, the holding metal fitting 40 is schematically configured by including, as a body portion: aside plate portion (body portion) 41 extended in the width direction X of the socket housing 21; and bottom plate portions (body portion) 42 formed by bending lower sides of both end portions of the side plate portion 41 at a substantially right angle toward a center side in the longitudinal direction Y of the socket housing 11. That is to say, the body portion of this embodiment is formed of the side plate portion 41 and the bottom plate portions 42 into a substantially L shape. Moreover, both end portions of the bottom plate portions 42 are protruded from both sides in the width direction X of the socket housing 21, whereby the attachment piece portions 42*a* to the circuit board are formed.

Figure 5:
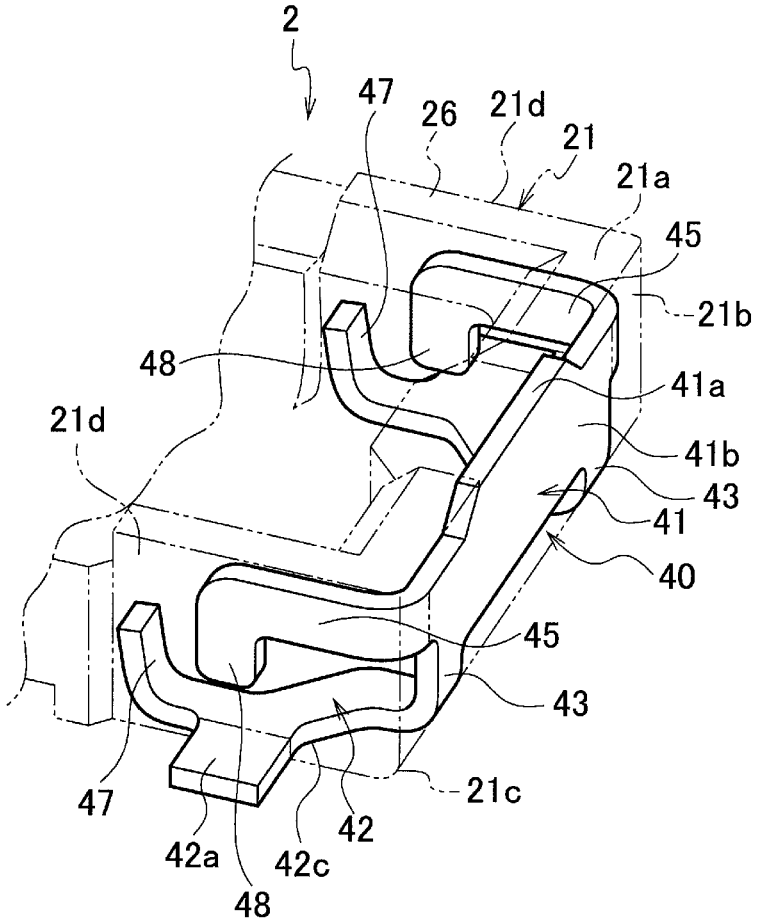
FIG. 5 is a perspective view showing, in a see-through manner, an attached state of the holding metal fitting shown in FIG. 1 to the socket housing.

FIG. 5 is a perspective view showing, in a see-through manner, an attached state of the holding metal fitting 40 to the socket housing 21. As shown in FIG. 5, when die-molding the socket housing 21, the holding metal fitting 40 is configured to be subjected to insert molding on the peripheral wall portion 26 of the socket housing 21. At this time, the holding metal fitting 40 is attached to the socket housing 21 in a state where the body portion is exposed along an outer wall surface of the peripheral wall portion 26 of the socket housing 21.

That is to say, an outer side surface 41*b* of the side plate portion 41 is exposed along an end surface (outer wall side surface) 21*b* in the longitudinal direction of the socket housing 21 in a state of becoming substantially flush with the end surface 21*b* concerned. Moreover, a top surface 41*a* of the side plate portion 41 is exposed along an outer wall top surface 21*a* of the socket housing 21. Meanwhile, lower surfaces 42*c* of the bottom plate portions 42 are also exposed along an outer wall lower surface 21*c* of the socket housing 21.

Then, the attachment piece portions 42*a* soldered to the circuit board are arranged so as to protrude outward from both end surfaces 21*d* of the socket housing 21 in the width direction X by a required amount.

Here, the holding metal fitting 40 includes anchor portions 45 which bite into an inside of the peripheral wall portion 26 of the socket housing 21. The anchor portions 45 are bent from the side plate portion 41 in a direction intersecting the height direction (vertical direction) Z of the socket housing 21. Specifically, as shown in FIG. 5, in this embodiment, along the longitudinal direction Y perpendicular to the height direction (vertical direction) Z, the longitudinal direction Y serving as the direction intersecting the height direction (vertical direction) Z, the anchor portions 45 are extended by being formed to be bent from the side plate portion 41. Then, a pair of the anchor portions 45 are individually allowed to bite into the inside of the peripheral wall portion 26 on the respective long sides of the socket housing 21.

Moreover, as shown in FIG. 5, on tip end sides of the bottom plate portions 42, engagement piece portions 47 are formed, which are bent from the pair of bottom plate portions 42 toward the outer wall top surface 21*a* of the socket housing 21. Then, when the holding metal fittings 40 are subjected to simultaneous insert molding into the holding metal fitting 40, both of the engagement piece portions 47 and the anchor portions 45 are embedded in the socket housing 21 in a state of biting into the socket housing 21. By the engagement piece portions 47 embedded in the socket housing 21, relative movement of the whole of each holding metal fitting 40 to the socket housing 21 can be regulated.

Figure 8:
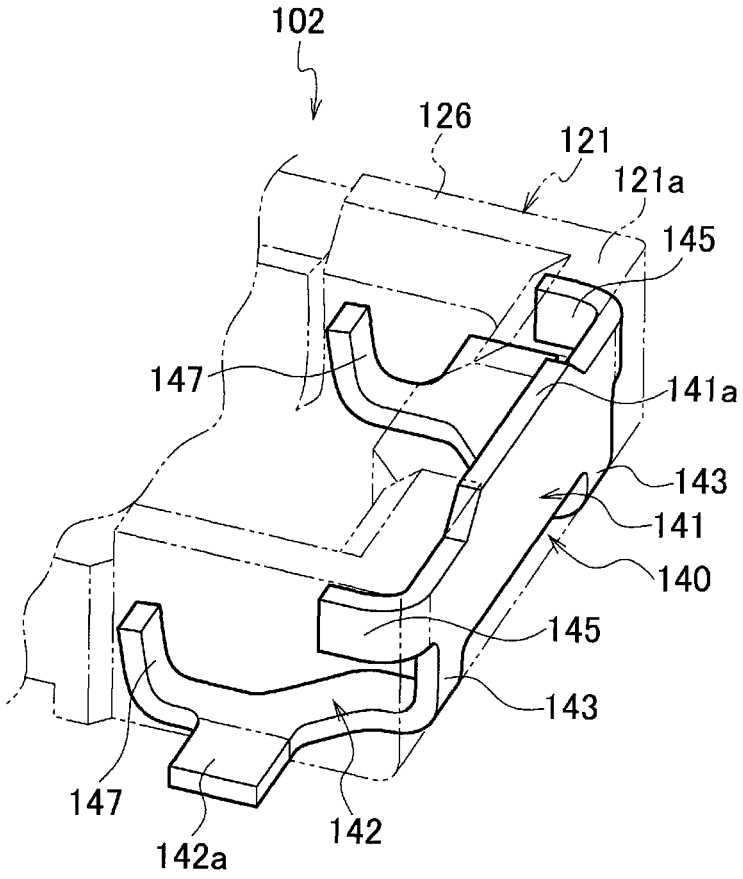
FIG. 8 is a perspective view showing, in a see-through manner, an attached state of a conventional holding metal fitting to the socket housing.

Incidentally, as shown in FIG. 8, with a configuration of a conventional holding metal fitting 140, anchor portions 145 which bite into a socket housing 121 are only bent from a side plate portion 141 in the longitudinal direction Y intersecting the height direction (vertical direction) Z, and accordingly, there has been an apprehension that the holding metal fitting 140 may come off by external force and the like. That is to say, in the case where a strong impact is applied to a socket 102, then with regard to the holding metal fitting 140, the side plate portion 141 rotationally moves about bent portions 143 of a body portion, which are taken as fulcrums, outward in the longitudinal direction Y of the socket housing 121, to cause a malfunction that the anchor portions 145 fall off the socket housing 121. In particular, in the case where the holding metal fitting 140 is exposed on a top surface 121*a* of the socket housing 121, there is an apprehension that the side plate portion 141 of the holding metal fitting 140 may rotationally move when an operator grasps a top surface 141*a* of the holding metal fitting 140 by the fingers and the like, and unexpected force acts in a direction of pushing down the side plate portion 141.

Accordingly, in this embodiment, as shown in FIG. 5, on the anchor portions 45 of the holding metal fitting 40, there are provided hook portions 48 bent in a direction intersecting an extended direction (longitudinal direction) Y of the anchor portions 45 concerned.

In this embodiment, the hook portions 48 are formed by bending the respective tip end sides of the pair of anchor portions 45 substantially at a right angle toward the outer wall lower surface 21*c* of the socket housing 21. That is to say, in this embodiment, along the height direction (vertical direction) Z vertical to the extended direction (longitudinal direction) Y of the anchor portions 45, the height direction Z serving as the direction intersecting the extended direction (longitudinal direction) Y, the hook portions 48 are extended by being formed to be bent from the anchor portions 45. Then, the hook portions 48 are also subjected to the insert molding in a state of being embedded in the socket housing 21. Note that, in this embodiment, the hook portions 48 are formed to be bent from the anchor portions 45 in the height direction (vertical direction) Z; however, as a matter of course, the hook portions 48 may be formed to be bent in the width direction X perpendicular thereto.

As described above, the holding metal fitting 40 of this embodiment is formed into a shape in which, with regard to the hook portions 48, the anchor portions 45, the side plate portions 41, the bottom plate portions 42 and the engagement piece portions 47, members arranged adjacent to each other are bent substantially at 90°, that is, substantially at a right angle with respect to each other. In other words, with regard to the holding metal fitting 40 of this embodiment, the hook portions 48, the side plate portion 41 and the engagement piece portions 47 are extended along the height direction (vertical direction) Z where the hook portions 48 are parallel to each other, the side plate portions 41 are parallel to each other, and the engagement piece portions 47 are parallel to each other, and the bottom plate portions 42 and the anchor portions 45 are extended along the longitudinal direction Y where the bottom plate portions 42 are parallel to each other and the anchor portions 45 are parallel to each other.

As described above, in accordance with the holding metal fitting 40 of this embodiment, also in the case where force acts in a direction where the side plate portion 41 falls by the external force and the like, the hook portions 48 hook on and are engaged with the resin in the socket housing 21 subjected to the insert molding. Hence, the holding metal fitting 40 can be further suppressed from coming off the socket housing 21.

As described above, in this embodiment, there are provided: the anchor portions 45 which bite into the socket housing 21 (housing); and the hook portions 48 bent in the height direction (vertical direction) Z intersecting the extended direction (longitudinal direction) Y of the anchor portions 45 concerned. Therefore, also in the case where the force acts in the direction for the side plate portion 41 to fall outward, the holding metal fitting 40 is engaged by the hook portions 48, and the holding metal fitting 40 can be suppressed from coming off the socket housing 21.

That is to say, according to this embodiment, there can be obtained: the holding metal fitting 40 capable of making itself difficult to come off the socket housing 21 even if the external force and the like are inputted thereto; the socket (connector element: connector connecting body) using the holding metal fitting 40 concerned; and the connector 1.

Moreover, in this embodiment, the side plate portion 41 is arranged so as to be exposed on the outer wall side surface 21*b* and outer wall top surface 21*a* of the socket housing 21. Then, the anchor portions 45 are provided by being bent from upper sides of both end portions in the longitudinal direction of the side plate portion 41, and the hook portions 48 are formed to be bent from the pair of anchor portions 45 toward the outer wall lower surface 21*c* of the socket housing 21. Hence, even in the case where the operator grasps the top surface 41*a* of the holding metal fitting 140 by the fingers and the like, and unexpected force acts in the direction of pushing down the side plate portion 41, the hook portions 48 located in the vicinity of the top surface 21*a* are engaged, and the holding metal fitting 40 can be suppressed from rotationally moving about the bent portions 43 taken as the fulcrums. In such a way, the anchor portions 45 can be inhibited more surely from falling off the socket housing 21.

Moreover, in this embodiment, the hook portions 48 are provided on the tip ends of the anchor portions 45. That is to say, the hook portions 48 are provided at positions apart from the side plate portion 41. Therefore, the holding metal fitting 40 can be further suppressed from rotationally moving about the bent portions taken as the fulcrums in the case where the force acts in the direction where the side plate portion 41 falls outward.

Still further, in this embodiment, the anchor portions 45 which bite into the socket housing 21 are provided on both end portions in the longitudinal direction Y of the side plate portion 41. Therefore, free end regions of the holding metal fitting 40 are reduced, resulting in an advantage that it can be made difficult for the holding metal fitting 40 to come off from the socket housing 21.

Note that, in this embodiment, the anchor portions 45 are formed to be bent from the side plate portion 41 along the perpendicular direction (longitudinal direction Y) perpendicular to the height direction (vertical direction) Z, the perpendicular direction serving as the direction intersecting the height direction (vertical direction) Z of the socket housing 21; however, the present invention is not limited to this. That is to say, the direction intersecting the height direction (vertical direction) Z includes directions other than that described above. Specifically, when the holding metal fitting 40 is viewed from the side (state of FIG. 4(*b*)), the anchor portions 45 may be provided so as to obliquely intersect the side plate portion 41, for example, within ranges of 45° to 90° (perpendicular), 90° (perpendicular) to 135° and the like from the side plate portion 41. Moreover, when the holding metal fitting 40 is viewed from above (state where the side plate portion 41 is viewed from above), the anchor portions 45 may be provided so as to obliquely intersect the side plate portion 41, for example, within ranges of 45° to 90° (perpendicular), 90° (perpendicular) to 135° and the like from the side plate portion 41.

Moreover, this also applies similarly to the direction of the hook portions 48, which intersects the extended direction (longitudinal direction) Y of the anchor portions 45. That is to say, when the holding metal fitting 40 is viewed from the side (state of FIG. 4(*b*)), the hook portions 48 may be provided so as to obliquely intersect the anchor portions 45, for example, within ranges of 45° to 90° (perpendicular), 90° (perpendicular) to 135° and the like from the anchor portions 45. Moreover, when the holding metal fitting 40 is viewed from above (state where the anchor portions 45 are viewed from above), the hook portions 48 may be provided so as to obliquely intersect the anchor portions 45, for example, within ranges of 45° to 90° (perpendicular), 90° (perpendicular) to 135° and the like from the anchor portions 45.

Second Embodiment

Figure 6:
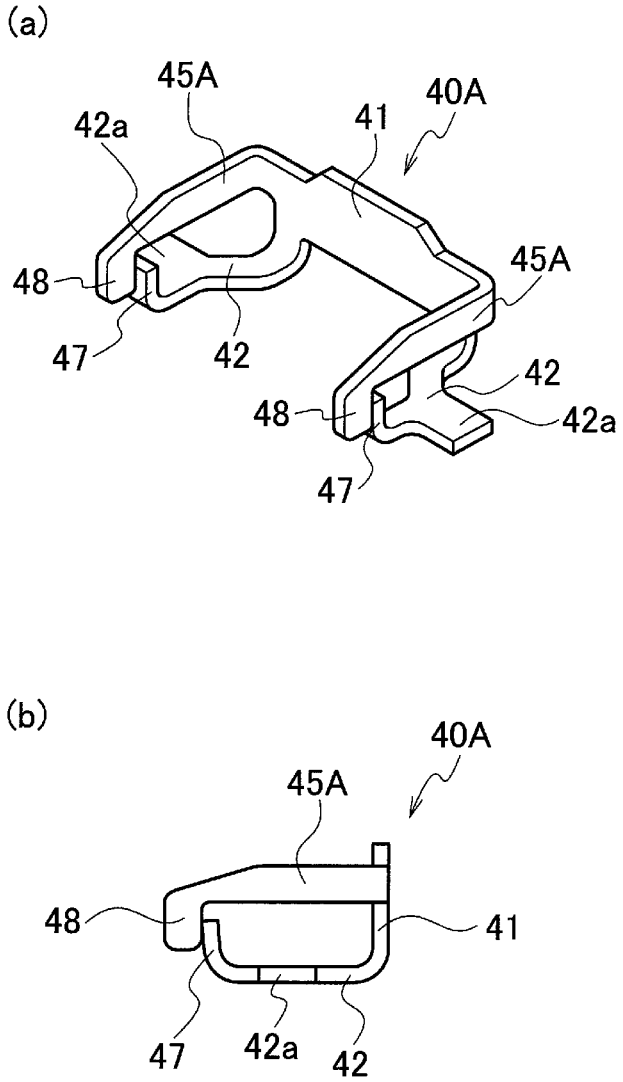
FIG. 6(*a*) and FIG. 6(*b*) are views showing a holding metal fitting embedded in a socket housing according to a second embodiment of the present invention.
Figure 7:
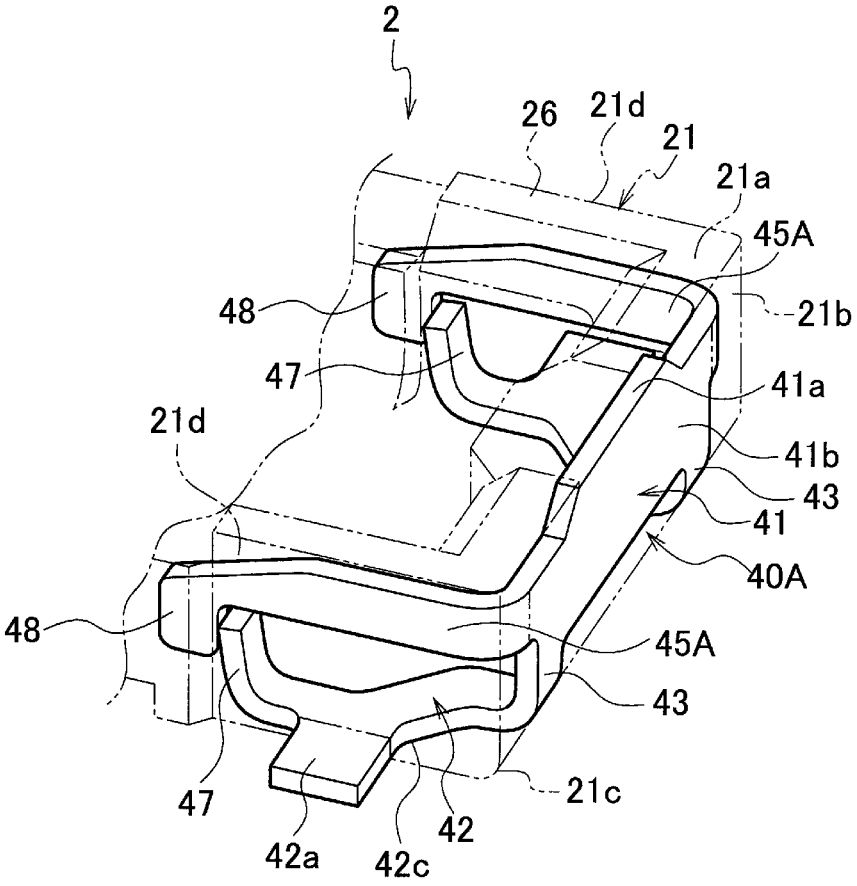
FIG. 7 is a perspective view showing, in a see-through manner, an attached state of the holding metal fitting shown in FIG. 6 to the socket housing.

FIG. 6 and FIG. 7 are views showing a second embodiment of the present invention, the same reference numerals are assigned to the same constituent portions as those of the above-described first embodiment, and the second embodiment is described by omitting a duplicate description.

A main difference of a holding metal fitting 40A of this embodiment from that of the above-described first embodiment is that anchor portions 45A are formed to be extended toward the center side in the longitudinal direction Y of the socket housing 21, and that the hook portions 48 are allowed to hook on the engagement piece portions 47.

That is to say, the holding metal fitting 40A includes: the side plate portion 41 arranged so as to be exposed on the outer wall side surface 21*b* and outer wall top surface 21*a* of the socket housing 21; and the bottom plate portions 42, which is bent from the lower sides of both end portions in the longitudinal direction Y of the side plate portion 41, and is exposed on the outer wall lower surface 21*c* of the socket housing 21. Then, on a pair of the bottom plate portions 42, the engagement piece portions 47 are provided, which are bent from the pair of bottom plate portions 42 toward the outer wall top surface 21*a* of the socket housing 21. A pair of the hook portions 48 are made to be individually engaged with the engagement piece portions 47.

With the configuration described above, according to the holding metal fitting 40A of this embodiment, there can be exerted similar functions and effects to those of the above-described first embodiment.

That is to say, according to this embodiment, there can be obtained: the holding metal fitting 40A capable of making itself difficult to come off the socket housing 21 even if the external force and the like are inputted thereto; a socket 2 (connector element: connector connecting body) using the holding metal fitting 40A concerned; and the connector 1.

Moreover, in this embodiment, the hook portions 48 are made engageable with the engagement piece portions 47. Therefore, also in the case where the force acts in the direction where the side plate portion 41 falls outward, the hook portions 48 are engaged with the engagement piece portions 47, and accordingly, the holding metal fitting 40 can be suppressed from rotationally moving about the bent portions 43 taken as the fulcrums, and the anchor portions 45 can be suppressed from coming off the socket housing 21. Moreover, in comparison with the above-described first embodiment, because of such a configuration with members (hook portions 48, engagement piece portions 47) of the holding metal fitting 40A engaged with each other is adopted, strength of the wall (socket housing 21) can be further enhanced. Hence, there is such an advantage as that the rotational movement of the holding metal fitting 40 (side plate portion 41) can be suppressed against stronger external force than in the above-described first embodiment.

Third Embodiment

Figure 9:
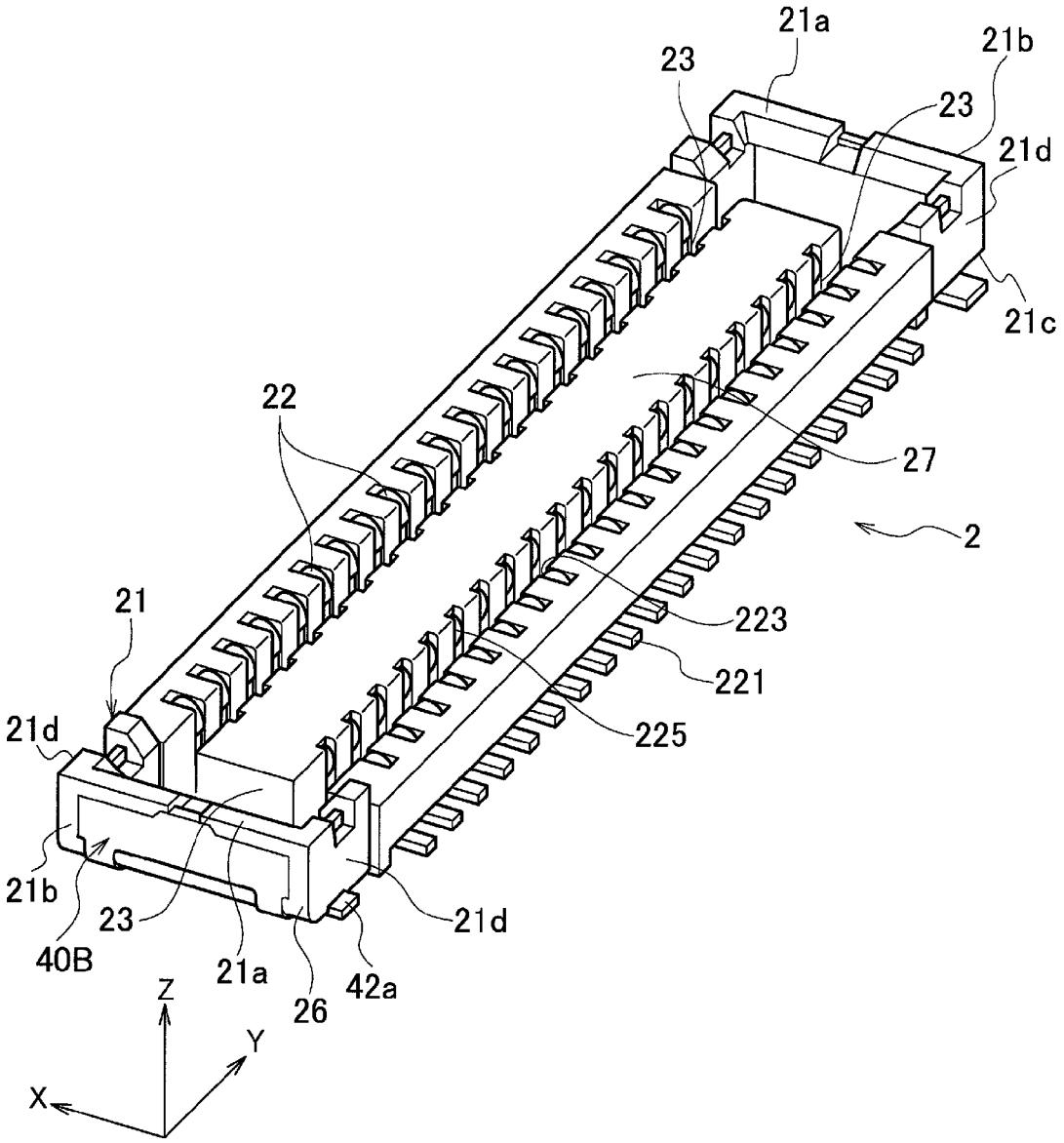
FIG. 9 is a perspective view of an entire socket of a connector according to a third embodiment of the present invention when viewed from obliquely above.
Figure 10:
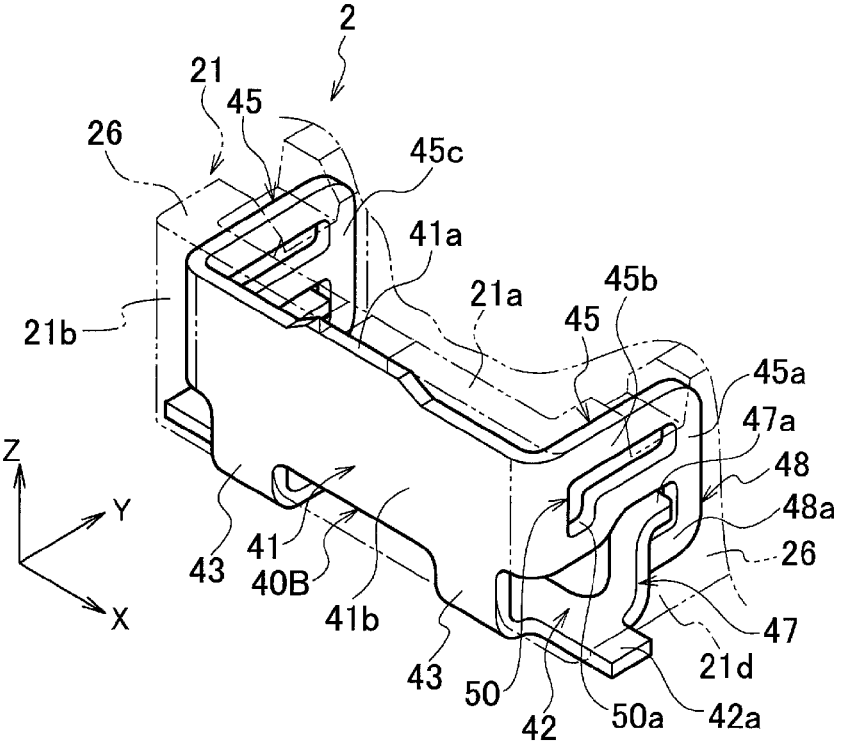
FIG. 10 is a perspective view showing, in a see-through manner, an attached state of a holding metal fitting shown in FIG. 9 to the socket housing.
Figure 11:
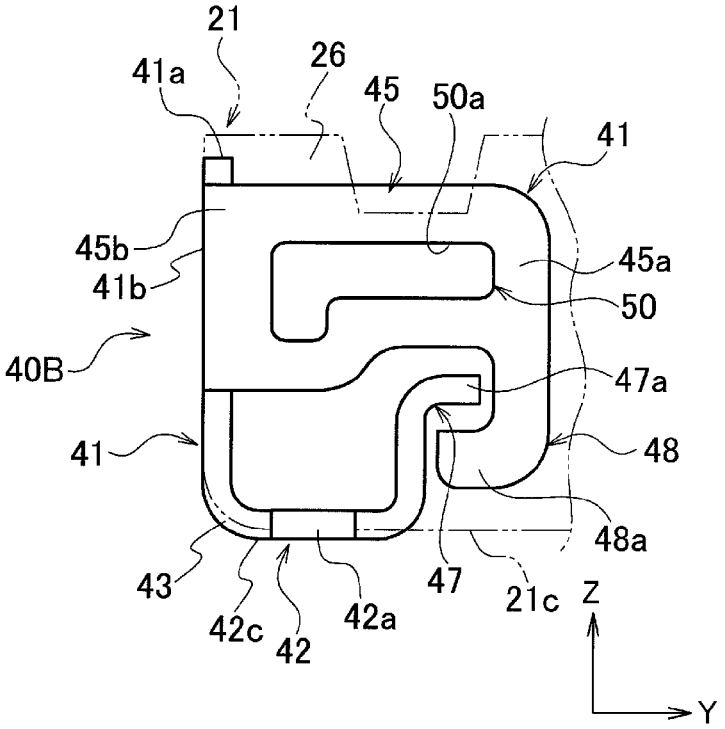
FIG. 11 is a side view of FIG. 10.

FIG. 9 to FIG. 11 are views showing a third embodiment of the present invention, the same reference numerals are assigned to the same constituent portions as those of the above-described first and second embodiments, and the third embodiment is described by omitting a duplicate description.

A main difference of a holding metal fitting 40B of this embodiment from those of the above-described first and second embodiments is that first nail portions 48*a* and second nail portions 47*a* are provided on tip end sides of the hook portions 48 and tip end sides of the engagement piece portions 47, respectively, and that the nail portions 47*a* and 48*a*, which make pairs, are arranged to oppose each other.

Specifically, as shown in FIG. 10 and FIG. 11, in the holding metal fitting 40B of this embodiment, the hook portions 48 are formed to extend downward individually from tip end portions 45*a* of a pair of the anchor portions 45. Then, on tip end sides (lower side in FIG. 11) of the pair of hook portions 48, the first nail portions 48*a* are individually provided in an extended manner, which are extended substantially in parallel to the anchor portions 45 toward the outside in the longitudinal direction Y of the socket 2. Meanwhile, the holding metal fitting 40B, is provided with the engagement piece portions 47 in a form to be bent upward individually from the pair of bottom plate portions 42. Then, on tip end sides (upper side in FIG. 11) of a pair of the engagement piece portions 47, the second nail portions 47*a* are individually provided to extend substantially in parallel to the anchor portions 45 toward the center side in the longitudinal direction Y of the socket 2.

Hence, each of the first nail portions 48*a* and each of the second nail portions 47*a* are extended in mutually opposite directions along the longitudinal direction Y of the socket 2, which serves as the extended direction of the anchor portions 45. Then, in this embodiment, the second nail portion 47*a* is allowed to enter a space surrounded by the first nail portion 48*a* and the hook portion 48, and these first nail portion 48*a* and second nail portion 47*a* are arranged to oppose each other with a slight gap therebetween. With such a configuration as described above, the resin in the socket housing 21 is sandwiched between the first nail portion 48*a* and the second nail portion 47*a* in such a manner that the holing metal fitting 40B is subjected to the insert molding into the socket housing 21.

Moreover, in this embodiment, when opposing each first nail portion 48*a* and each second nail portion 47*a* to each other, the second nail portion 47*a* is provided on the tip end side of the engagement piece portion 47 at a position to exceed at least the first nail portion 48*a* in the height direction Z of the socket housing 21. In such a way, the second nail portion 47*a* on the bottom plate portion 42 side can always be located above the first nail portion 48*a* on the anchor portion 45 side, in the height direction Z. Hence, in the case where the holding metal fitting 40B rotationally moves about the bent portions 43 as the fulcrums, it is made possible to engage the first nail portions 48*a* with the second nail portion 47*a* sides, and the holding metal fitting 40B can be further suppressed from coming off the socket housing 21.

Moreover, in this embodiment, on wall surfaces of the anchor portions 45, which bite into the socket housing 21, engagement portions 50 are provided, with which the resin in the socket housing 21 is engaged. Specifically, as shown in FIG. 10 and FIG. 11, in this embodiment, each of the engagement portions 50 is formed as a through hole 50*a* that penetrates an outer wall surface 45*b* and inner wall surface 45*c* of the anchor portion 45.

In this embodiment, each of the through holes 50*a* is formed as a substantially L-shaped through hole 50*a* formed of: a band plate-like long hole extended along the longitudinal direction Y of the anchor portion 45; and a band plate-like short hole extended downward from one end on an outside in the longitudinal direction Y of this long hole. By the through hole 50*a* as described above, the resin in the socket housing 21 is interposed into the through hole 50*a* and is engaged with the through hole 50*a* when each of the anchor portions 45 is subjected to the insert molding into the socket housing 21. Hence, in the case where the force acts in the direction where the side plate portion 41 falls outward, the anchor portion 45 hooks on and is engaged with the resin in the through hole 50*a*, whereby the holding metal fitting B can be further suppressed from coming off the socket housing 21.

With the configuration described above, according to the holding metal fitting 40B of this embodiment, similar functions and effects to those of the above-described first embodiment can be exerted.

That is to say, according to this embodiment, there can be obtained: the holding metal fitting 40B capable of making itself difficult to come off the socket housing 21 even if the external force and the like are inputted thereto; a socket 2 (connector element: connector connecting body) using the holding metal fitting 40B concerned; and the connector 1.

Moreover, in this embodiment, on each of the hook portions 48, the first nail portion 48*a* extended substantially in parallel to the anchor portion 45 is provided in an extended manner. Meanwhile, the second nail portion 47*a* extended substantially in parallel to the anchor portion 45 is provided in an extended manner on the tip end side of the engagement piece portion 47 at a position to exceed at least the first nail portion 48*a* in the height direction Z of the socket housing 21. Then, these first nail portion 48*a* and second nail portion 47*a* are arranged to oppose each other, and accordingly, in the case where the holding metal fitting 40B rotationally moves about the bent portions 43 as the fulcrums, it is made possible to engage these first nail portion 48*a* and second nail portion 47*a* with each other. Hence, it is made possible to suppress further rotational movement of the holding metal fitting 40B, and there are advantages that the holding metal fitting 40B can be further suppressed from coming off the socket housing 21, and in addition, that further breakage of the socket housing 21 can be prevented.

Here, in the above-described second embodiment, the hook portions 48 are engaged with the engagement piece portions 47; however, depending on an acting direction of the force inputted to the holding metal fitting 40A, there is an apprehension that the hook portions 48 may come off the engagement piece portions 47 following the rotational movement of the holding metal fitting 40A. In this point, it is made possible to more widely cope with the acting direction of the force in the direction where the holding metal fitting 40B comes off, and accordingly, this embodiment is more suitable.

Moreover, in this embodiment, the gap is provided between the first nail portion 48*a* and the second nail portion 47*a*, and the resin in the socket housing 21 is sandwiched between these first nail portion 48*a* and second nail portion 47*a*. Therefore, when the force acts in the direction where the holding metal fitting 40B comes off, the resin in the socket housing hooks between the first nail portion 48*a* and the second nail portion 47*a*, so that strength of the holding metal fitting 40B against the rotation direction thereof can be enhanced.

Moreover, in this embodiment, the engagement portion 50 with which to engage the resin in the socket housing 21 is provided in the wall surface (outer wall surface 45*b*, inner wall surface 45*c*) of each of the anchor portions 45. Therefore, the holding metal fitting 40B can be further suppressed from coming off the socket housing 21, and the peripheral wall portion 25 of the socket housing 21 can be further prevented from being broken by such coming-off of the holding metal fitting 40B.

Furthermore, in this embodiment, the engagement portion 50 is formed as the through hole 50*a* that penetrates the outer wall surface 45*b* and inner wall surface 45*c* of each of the anchor portions 45. Therefore, it is made possible to allow the resin in the socket housing 21 to communicate between the outer wall surface 45*b* side and inner wall surface 45*c* side of the anchor portion 45. In such a way, engaging strength between the engagement portion 50 and the resin can be enhanced, and the holding metal fitting 40B can be further suppressed from coming off.

Still further, in this embodiment, the anchor portion 45 is extended from the side plate portion 41 so as to go along the longitudinal direction Y of the socket 2. Therefore, the through hole 50*a* as the engagement portion 50 can be formed in the width direction X perpendicular to the longitudinal direction Y serving as the direction where the side plate portion 41 falls (comes off), so that the holding metal fitting 40B can be further suppressed from rotationally moving about the bent portions 43 as the fulcrums.

Moreover, as shown in FIG. 9 and FIG. 10, in this embodiment, when the holding metal fitting 40B is subjected to the insert molding into the socket housing 21, the top surface 41*a* of the sideplate portion 41 is configured not to be exposed along the upper end surface 21*a* of the socket housing 21. Therefore, the operator can be suppressed from grasping the top surface 41*a* of the side plate portion 41 by the fingers and the like, thereby reducing a risk for the operator to push down the side plate portion 41 to rotationally move the holding metal fitting 40B.

Fourth Embodiment

Figure 12:
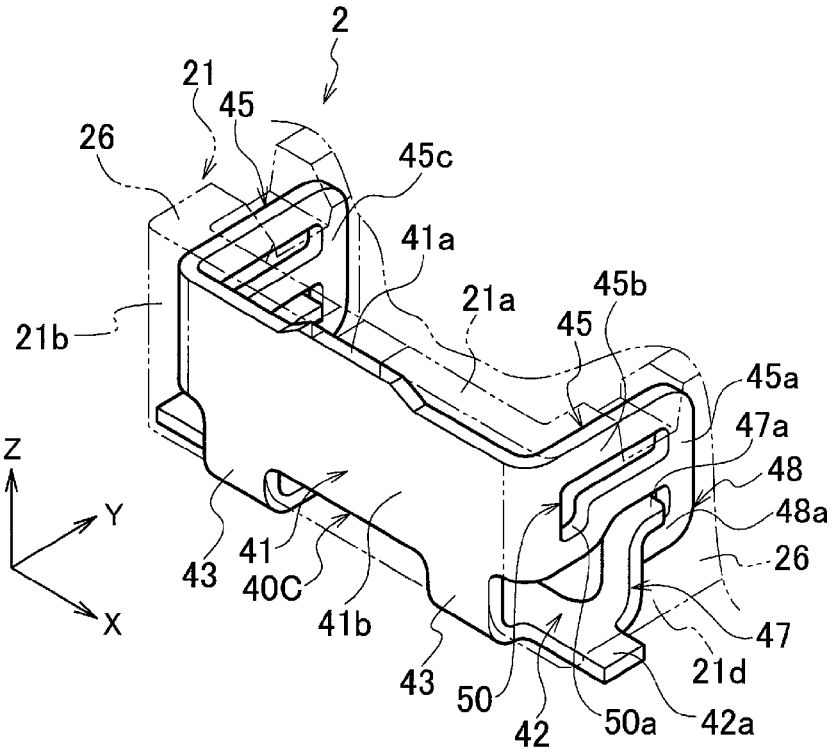
FIG. 12 is a perspective view showing, in a see-through manner, an attached state of a holding metal fitting according to a fourth embodiment of the present invention to the socket housing.
Figure 13:
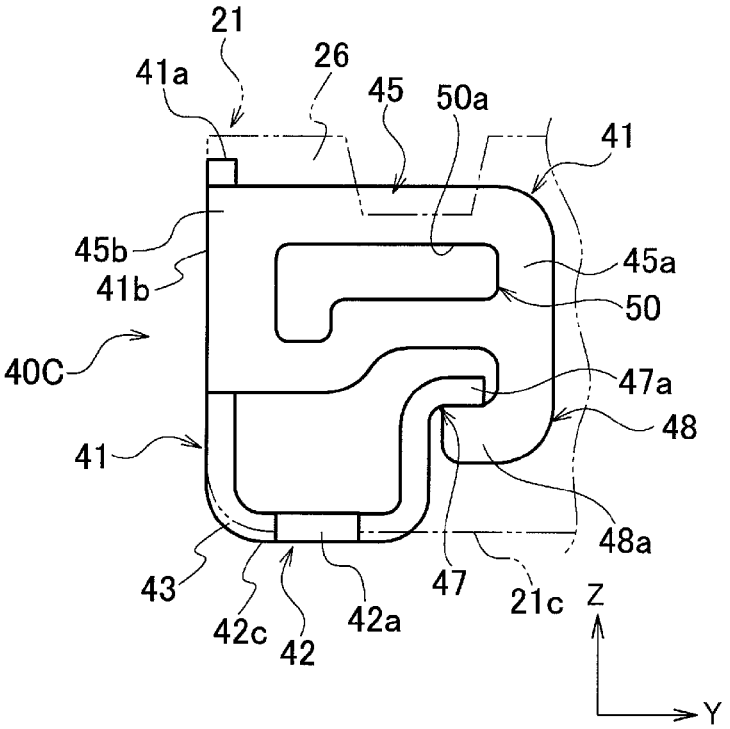
FIG. 13 is a side view of FIG. 12.

FIG. 12 and FIG. 13 are views showing a fourth embodiment of the present invention, the same reference numerals are assigned to the same constituent portions as those of the above-described first to third embodiments, and the fourth embodiment is described by omitting a duplicate description.

A main difference of a holding metal fitting 40C of this embodiment from that of the above-described third embodiment is that each of the first nail portions 48*a* and each of the second nail portions 47*a* are provided in contact with each other, and that these first nail portion 48*a* and second nail portion 47*a* are engaged with each other.

With the configuration described above, according to the holding metal fitting 40C of this embodiment, there can be exerted similar functions and effects to those of the above-described first embodiment.

That is to say, according to this embodiment, there can be obtained: the holding metal fitting 40C capable of making itself difficult to come off the socket housing 21 even if the external force and the like are inputted thereto; a socket 2 (connector element: connector connecting body) using the holding metal fitting 40C concerned; and the connector 1.

Moreover, in this embodiment, the first nail portion 48*a* and the second nail portion 47*a* are provided in contact with each other, and these first nail portion 48*a* and second nail portion 47*a* are engaged with each other. Therefore, members of the holding metal fitting 40C can be engaged with each other, and accordingly, strength of the holding metal fitting 40C against the rotation direction can be further enhanced, and it can be made further difficult for the holding metal fitting 40C to come off from the socket housing 21.

The description has been made above of the preferred embodiments of the present invention; however, the present invention is not limited to the above-described embodiments, and is modifiable in various ways.

For example, in the above-described embodiments, the description has been made of the cases where the connector element according to the present invention is embodied as the socket; however, needless to say, the connector element can be embodied also as the header.

Moreover, specifications such as shapes, sizes and materials of the housing, contacts, posts and the like of the connector element are also changeable as appropriate.

Moreover, in the above-described third and fourth embodiments, the hook portions are formed to be bent downward from the anchor portions; however, the hook portion may be formed to be bent upward from the anchor portion. Also in this case, the first nail portion extended substantially in parallel to the anchor portion can be provided. Moreover, for this, for example, the engagement piece portion is formed to be bent so as to go around from the tip end side of this engagement piece portion, and the second nail portion is provided on the tip end side of the engagement piece portion, at the position to exceed the first nail portion in the height direction, whereby such an operation in the rotation direction of the holding metal fitting can be regulated.

Moreover, in the above-described third and fourth embodiments, the through hole that penetrates the anchor portion is provided as the engagement portion; however, without being limited to this, recessed portions and protruding portions may be provided as engagement portions on the wall surfaces (outer wall surface, inner wall surface) of the anchor portion, for example. Moreover, a plurality (two or more) of these engagement portions may be provided for each of the pair of anchor portions.

Figure 14:
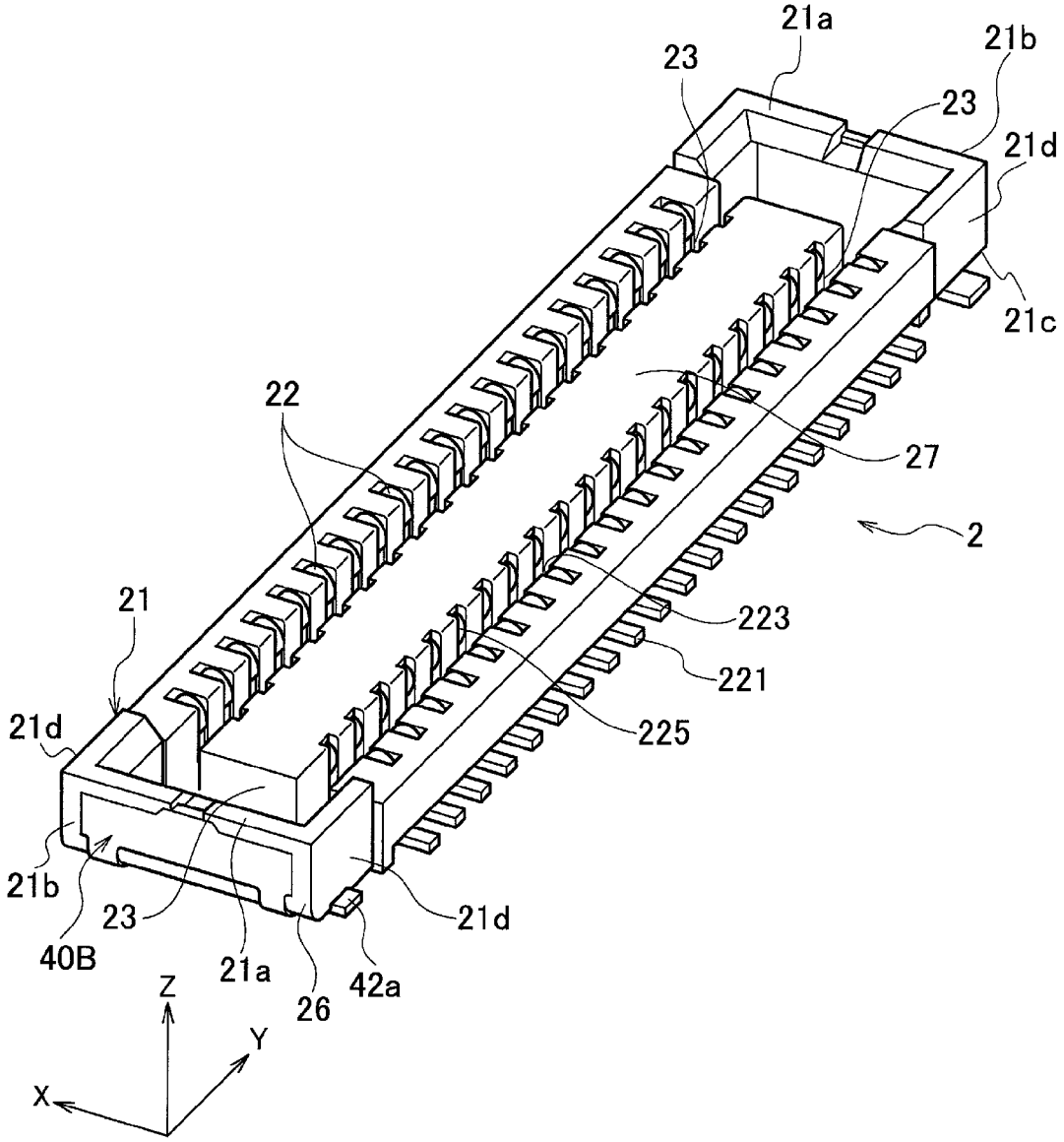
FIG. 14 is a view showing a modification example of the connector according to the third embodiment of the present invention.
Figure 15:
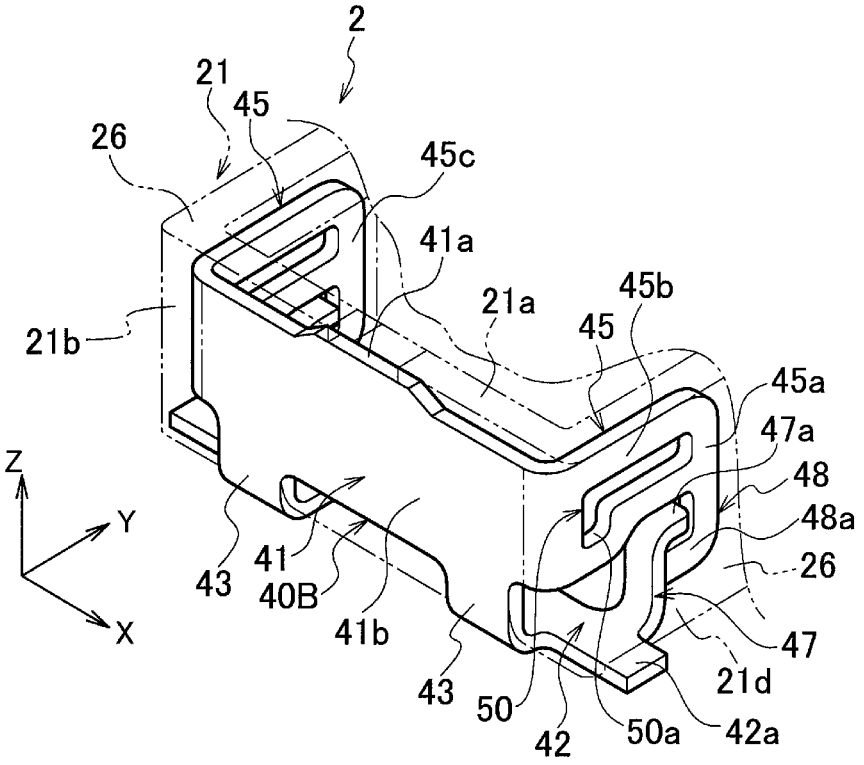
FIG. 15 is a perspective view showing, in a see-through manner, an attached state of a holding metal fitting shown in FIG. 14 to the socket housing.

Furthermore, in the above-described third and fourth embodiments, the anchor portions of the holding metal fitting are configured so as to be exposed on the respective peripheral wall portions of both end portions in the longitudinal direction of the socket housing; however, they may be configured so as not to be exposed thereon as in a modification example shown in FIG. 14 and FIG. 15.

REFERENCE SIGNS LIST

1 CONNECTOR
2 SOCKET (ONE OF CONNECTOR ELEMENTS)
3 HEADER (OTHER CONNECTOR ELEMENT)
21 SOCKET HOUSING (HOUSING)

21*a* OUTER WALL TOP SURFACE
21*b* OUTER WALL SIDE SURFACE
21*c* OUTER WALL LOWER SURFACE
40 HOLDING METAL FITTING
40A HOLDING METAL FITTING
41 SIDE PLATE PORTION (BODY PORTION)
42 BOTTOM PLATE PORTION (BODY PORTION)
42*a* ATTACHMENT PIECE PORTION
45 ANCHOR PORTION
45A ANCHOR PORTION
47 ENGAGEMENT PIECE PORTION
48 HOOK PORTION
Z VERTICAL DIRECTION (HEIGHT DIRECTION)

The invention claimed is:

1. A holding metal fitting embedded in a housing of a connector element, the connector element having a contact for electrically connecting the connector element and another connector element, the holding metal fitting including:

a substantially L-shaped body portion that has a side plate portion and a bottom plate portion;

an anchor portion that is bent from the side plate portion in a direction intersecting a height direction of the housing and bites into the housing; and a hook portion that is bent from the anchor portion in a direction intersecting an extended direction of the anchor portion.

2. The holding metal fitting according to claim 1, wherein the side plate portion is arranged to be exposed on an outer wall side surface of the housing, and in addition, the bottom plate portion is arranged to be exposed on an outer wall lower surface of the housing.

3. The holding metal fitting according to claim 1, wherein the side plate portion is arranged to be exposed on the outer wall side surface and outer wall top surface of the housing, and a pair of the anchor portions are provided by being bent from upper sides of both end portions in a longitudinal direction of the side plate portion, and in addition, a pair of the hook portions are formed to be bent from the pair of anchor portions toward the outer wall lower surface of the housing.

4. The holding metal fitting according to claim 1, wherein the hook portion is provided on a tip end of the anchor portion.

5. The holding metal fitting according to claim 1, further including:

an engagement piece portion bent from the bottom plate portion toward an outer wall top surface of the housing, wherein the hook portion is made engageable with the engagement piece portion.

6. The holding metal fitting according to claim 1, further including:

an engagement piece portion bent from the bottom plate portion toward an outer wall top surface of the housing, wherein a first nail portion extended substantially in parallel to the anchor portion is provided on the hook portion in an extended manner, and in addition, a second nail portion extended substantially in parallel to the anchor portion is provided in an extended manner on a tip end side of the engagement piece portion at a position to exceed at least the first nail portion in the height direction of the housing, and the first nail portion and the second nail portion are arranged to oppose each other.

7. The holding metal fitting according to claim 6, wherein a gap is provided between the first nail portion and the second nail portion, and resin in the housing is sandwiched between the first nail portion and the second nail portion.

8. The holding metal fitting according to claim 6, wherein the first nail portion and the second nail portion are provided in contact with each other, and the first nail portion and the second nail portion are made engageable with each other.

9. A connector element, wherein the connector element uses the holding metal fitting according to claim 1.

10. A connector, wherein the connector uses the connector element according to claim 9 as at least one of connector elements.

11. The holding metal fitting according to claim 1, wherein the holding metal fitting is embedded in the housing by insert molding.

* * * * *